US010390595B2

(12) United States Patent
Godshaw et al.

(10) Patent No.: US 10,390,595 B2
(45) **Date of Patent: *Aug. 27, 2019**

(54) CUT-PROOF ANTI-THEFT BAG CONSTRUCTION

(71) Applicant: Travel Caddy, Inc., Elk Grove Village, IL (US)

(72) Inventors: Donald E. Godshaw, Wilmette, IL (US); Du Hai, Uncasville, CT (US)

(73) Assignee: Travel Caddy, Inc., Elk Grove Village, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/484,472

(22) Filed: Apr. 11, 2017

(65) Prior Publication Data

US 2017/0215539 A1 Aug. 3, 2017

Related U.S. Application Data

(60) Continuation of application No. 14/559,086, filed on Dec. 3, 2014, now Pat. No. 9,655,424, which is a (Continued)

(51) Int. Cl.

| | |
|---|---|
| ***A45C 13/18*** | (2006.01) |
| ***A45C 3/00*** | (2006.01) |
| ***A45C 3/06*** | (2006.01) |
| ***A45C 13/10*** | (2006.01) |
| ***A45C 13/20*** | (2006.01) |
| ***A45C 13/30*** | (2006.01) |
| *A45C 13/02* | (2006.01) |

(52) U.S. Cl.

CPC ..... *A45C 13/185* (2013.01); *A45C 3/001* (2013.01); *A45C 3/06* (2013.01); *A45C 13/103* (2013.01); *A45C 13/1023* (2013.01); *A45C 13/18* (2013.01); *A45C 13/20* (2013.01); *A45C 13/30* (2013.01); *A45C 2013/026* (2013.01); *A45C 2013/306* (2013.01); *Y10T 29/49* (2015.01); *Y10T 29/5187* (2015.01)

(58) Field of Classification Search

CPC ..... A45C 13/103; A45C 13/18; A45C 13/183; A45C 13/10; A45C 13/185

USPC ..... 150/101

See application file for complete search history.

(56) References Cited

U.S. PATENT DOCUMENTS

| | | | | |
|---|---|---|---|---|
| 873,195 A | | 12/1907 | Willets | |
| 4,885,570 A | * | 12/1989 | Chien | G08B 13/1445 150/101 |

(Continued)

FOREIGN PATENT DOCUMENTS

| | | |
|---|---|---|
| FR | 2601566 B1 | 7/1986 |
| GB | 26827 B1 | 11/1910 |

(Continued)

*Primary Examiner* — Sue A Weaver

(74) *Attorney, Agent, or Firm* — Nancy R. Gamburd; Gamburd Law Group LLC

(57) ABSTRACT

In one form, a security handbag is provided that includes an interior security panel assembly with a matrix of wires secured between a pair of material layers. The interior security panel assembly can be positioned intermediate the bag outside wall and a lining of the bag. A strap with security cable and a carabiner attachment device can be attached to the handbag. Methods for forming such security panel assemblies are also provided.

28 Claims, 20 Drawing Sheets

Related U.S. Application Data division of application No. 13/245,319, filed on Sep. 26, 2011, now Pat. No. 8,925,181, which is a continuation-in-part of application No. PCT/US2010/028557, filed on Mar. 24, 2010, which is a continuation-in-part of application No. 12/410,123, filed on Mar. 24, 2009, now abandoned.

(56) References Cited

U.S. PATENT DOCUMENTS

| | | | | |
|---|---|---|---|---|
| 6,227,015 | B1 * | 5/2001 | Luquire | E05B 37/025 24/598.1 |
| 7,661,223 | B2 * | 2/2010 | Dudney | A01K 97/08 206/315.11 |
| 9,655,424 | B2 * | 5/2017 | Godshaw | A45C 3/001 |
| 2003/0110818 | A1 * | 6/2003 | Schlipper | A45C 13/1046 70/18 |
| 2007/0102469 | A1 | 5/2007 | Roth | |
| 2007/0240798 | A1 * | 10/2007 | Bihler | A45C 13/18 150/102 |
| 2012/0125494 | A1 * | 5/2012 | Avganim | A45C 13/20 150/101 |
| 2013/0299540 | A1 * | 11/2013 | Avganim | A45C 13/18 224/600 |
| 2014/0090942 | A1 * | 4/2014 | Schlipper | A45C 3/001 190/125 |
| 2014/0105522 | A1 * | 4/2014 | Schlipper | E04G 21/3261 383/117 |

FOREIGN PATENT DOCUMENTS

| | | | |
|---|---|---|---|
| GB | 162091 | B1 | 1/1920 |
| JP | 2002363838 | A1 | 12/2002 |

* cited by examiner

CUT-PROOF ANTI-THEFT BAG CONSTRUCTION

CROSS-REFERENCE TO RELATED APPLICATIONS

This application is a continuation of and claims the benefit of and priority to U.S. patent application Ser. No. 14/559,086, filed on Dec. 3, 2014, which is division of U.S. patent application Ser. No. 13/245,319, filed on Sep. 26, 2011 and now U.S. Pat. No. 8,925,181 issued Jan. 6, 2015, which is a continuation-in-part of prior International Application PCT/US10/028557, filed on Mar. 24, 2010, which is a continuation-in-part of U.S. patent application Ser. No. 12/410,123, filed on Mar. 24, 2009 and now abandoned, all of which are hereby incorporated herein by reference in their entirety. U.S. patent application Ser. No. 14/856,724, filed Sep. 27, 2015 and now U.S. Pat. No. 9,486,047 issued Nov. 8, 2016, is also a continuation of U.S. patent application Ser. No. 14/559,086.

FIELD OF THE INVENTION

This invention relates to various types of carrying bags and, more particularly, to security panel assemblies and methods of forming the same for such bags.

BACKGROUND OF THE INVENTION

In a principal aspect the present invention relates to a handbag, purse, travel bag or the like which incorporates construction features designed to preclude access to the interior of the bag by cutting though the sides of the bag.

Handbags, travel bags, purses and the like are often made from flexible materials such as cloth, canvas, leather and similar materials. Such bags typically include one or more interior chambers through which access may be gained by an opening in the top or side of the bag. Such bags also often include a carry strap which is typically connected between opposite sides of the bag. Additionally, such bags often also include multiple side pockets with side access openings.

On occasion, such bags are subject to theft. For example, often a bag may be hung or supported by the bag strap on a chair or a hook or the like. In such circumstances, a thief may "snatch" the bag by grabbing the strap and departing. Another scheme that has been used by thieves is to use a sharp instrument to cut through the soft sided material comprising the bag.

This provides access to the contents which may be lifted through the cut opening in the bag.

Issues of this nature have been addressed in various ways by certain security designs for soft sided types of bag constructions. For example, U.S. Pat. No. 6,026,662 entitled "Security Device for Luggage" issued Feb. 22, 2000 and the references cited therein teach a method for providing a metal mesh that is placed over a backpack in order to enhance the security of the soft sided backpack. A related patent, U.S. Pat. No. 6,244,081 is entitled "Security Device for Luggage" issued Jun. 12, 2001 discloses a security device in the form of a netting with a locking mechanism associated therewith. U.S. Pat. No. 7,069,753 entitled "Security Luggage Bag" issued Jul. 4, 2006 discloses the concept of placement of a wire mesh within the interior of a bag and further providing a draw cord made from a wire cable to close the top of the bag. These prior art patents and the references cited therein are incorporated herewith by reference.

While such constructions have potential applicability to handbags, they are difficult to assemble, can be bulky and unattractive and may not provide adequate security, particularly with respect to handbags that have carry straps associated therewith. In view of these and other challenges, the present invention was developed.

SUMMARY OF THE INVENTION

Briefly, in one form, the present invention comprises a security construction having a panel assembly which, in one form, is placed within an exterior bag of the type fabricated from generally flexible material such as fabric, leather or plastic. The security panel assembly is typically positioned between the exterior layer of material forming the bag and an interior lining as an interior security panel assembly. The concepts associated with the interior security panel assembly may be utilized as a single interior panel assembly or as multiple assemblies associated with multiple pockets of the exterior bag. Further, the high security bag may include a cable or wire which is flexible and incorporated into or with the elongate strap that connects to sides of the bag. The wire or cable may include a carabiner which is maintained in a side pocket of the bag and may be released so that the carry strap can be placed around a post or some other object so that it cannot be "snatched" easily. Security clasps are also provided on the zipper closures for the exterior bag.

The interior security panel assembly in one embodiment includes at least first and second layers of foldable material having at least one cut-resistant cable or wire positioned therebetween and stitched into place between the foldable first and second material layers. In one form, binding is provided around at least a portion of the foldable material first and second layers to further encapsulate the material layers and the matrix of wire or wires between those layers. In another preferred form, glue or adhesive may be incorporated between the layers to further retain the wire or wires in a fixed position. Additionally, the first and second layers of material are stitched together to facilitate maintenance of the matrix of wire or wires in a desired array between the first and second layers of material. The first and second layers of material are typically a fabric, non-woven, or plastic material which is foldable. The security panel assembly, which is comprised of the layers of fabric and the wire mesh matrix, may be fitted into the exterior bag and positioned intermediate the exterior material forming the bag and a liner material, tacked in that position and then stitched or otherwise attached to various seams or margins of the bag.

In another aspect, the security panel assembly can be provided along the exterior of a more rigid bag or container. In this form, the panel assembly can be resiliently flexible and thus also serve as a hinge between a rigid container base and a pivotal cover therefor. The security panel assembly can have a finishing cover thereon, such as of fabric material.

As another feature the wire cable that is associated with the carry strap may be fastened to the bag or to the security panel to thereby insure that the wire cable in the strap cannot be disengaged easily from the handbag itself. Further, clasps on the zipper pulls or fastener pulls for the opening to the bag lock or attach to the bag so that access openings cannot be easily opened.

In another aspect, a method for forming a security panel assembly is provided. The method can include holding a first layer of material in a substantially fixed position via mounting members and, in a preferred form, on a fixture via the insertion of mounting pegs of the fixture through openings of the material layer so that the mounting pegs project therethrough. Thereafter, a wire is routed around the pegs in a predetermined pattern. A second layer of material is then oriented so that openings thereof can be aligned with the mounting pegs and is placed onto the pegs so that they extend through the material layer openings. The layers are urged together so that adhesive therebetween is effective to hold the material layers and the wire therebetween securely relative to each other. While a single wire can advantageously be employed for forming the security panel assembly herein, it is manifest that the present method is not limited to a single wire and multiple wires can instead be secured between the material layers. Further, while the wire can be a metallic material, it could also be cut-resistant yarn material such as Vectran. In addition, the material layers can be panels of flexible and foldable material, such as a fabric, non-woven or thin plastic material, and the panels can be of different material from each other such as use of a non-woven material for the first material layer or panel and a woven fabric material for the second material layer or panel.

The laminate of the material layers and wire or wires therebetween is then sewn to further secure the wire or wires permanently in place between the material layers. In this regard, the sewing can occur at random locations, as well as around the perimeter of the material layers. In addition, a connecting panel or panels such as in the form of wings or smaller tabs can be sewn to one or both of the ends and/or sides of the panel assembly for use in attaching the security panel assembly in a carry bag.

As an alternative, the second layer of material need not include openings for being aligned with the mounting pegs. Rather, the layer of material can include notches such as V-shaped openings formed at the perimeter edge to be open thereto for being aligned with the mounting pegs. In this manner, the mounting pegs need not be fit into through openings in the second layer of material which translates to a decrease in assembly time for the security panel assembly herein.

Thus, it is an object of the invention to provide a security type bag or handbag having a security carry strap wherein the external materials forming the bag may be a flexible, fabric material which is attractive.

Yet another object of the invention is to provide a highly secure handbag which includes wires and cables that are incorporated therein, particularly within the interior chamber or chambers or pockets of the handbag to protect the contents of the bag and to prevent the cutting or slashing of the bag so as to secure access to the interior.

Yet another object of the invention is to provide a highly secure handbag having a carry strap which may be easily detached and reattached and fastened in a secure manner around a post or a chair, or some other object to prevent the bag from being "snatched".

Another object of the invention is to provide a secure handbag construction which is reasonably priced, highly secure, with unobtrusive features and which is reasonably easy to assemble or manufacture.

These and other objects, advantages and features of the invention will be set forth in the detailed description which follows.

BRIEF DESCRIPTIONS OF THE DRAWINGS

In the detailed description which follows, reference will be made to the drawing comprised of the following figures.

FIGS. 29-36 (with FIG. 33 divided into FIG. 33A and FIG. 33B) are isometric views illustrating steps in the manufacture of another security panel assembly.

DETAILED DESCRIPTION OF THE PREFERRED EMBODIMENTS

Figure 1:
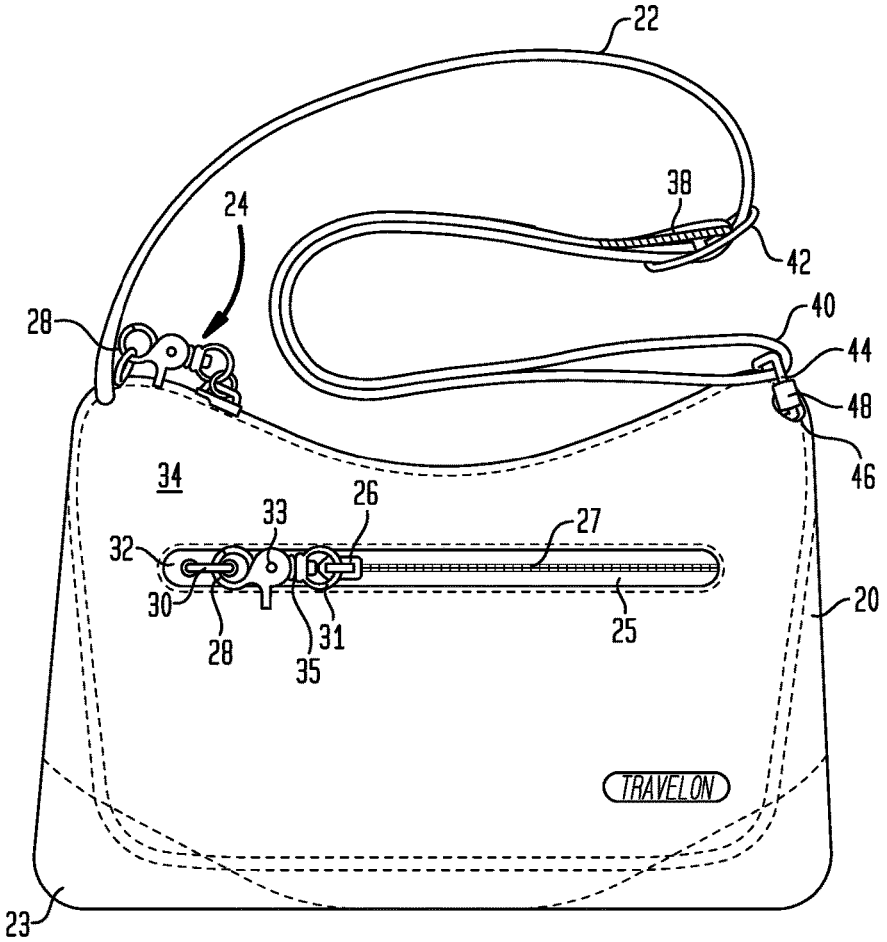
FIG. 1 is a side elevation of a typical handbag incorporating the features of the invention.

FIG. 1 is a front elevation of a typical handbag incorporating security features associated with the present invention. Handbag 20 includes a carry strap 22 and is defined by an exterior bag 23 configured, in the example, as a parallelepiped construction of a generally flexible material such as canvas, leather, flexible plastic material and similar materials. The exterior bag 23 may further include reinforcement features such as ribs or slats that are incorporated therein or PVC sheets that are incorporated on the inside surface or sewn to the inside of the material forming the exterior bag 23. Typically, the exterior bag 23 includes a top opening 21 which is accessible though a zipper or closure mechanism 24. The exterior bag 23 may also include a side pocket 25 accessible through an opening 27 with a zipper mechanism 26.

Figure 19:
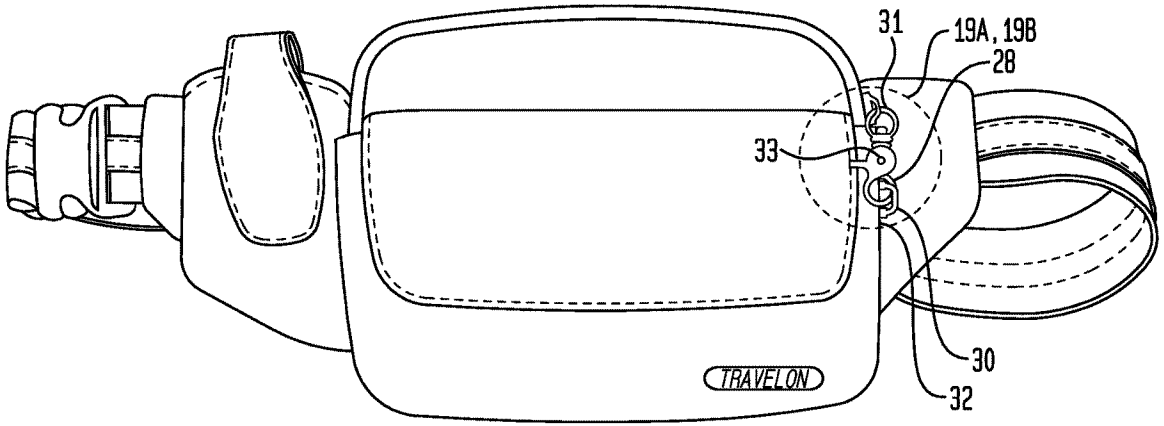
FIGS. 19, 19A and 19B are enlarged isometric views of a security clasp for a zipper mechanism.
Figure 19B:
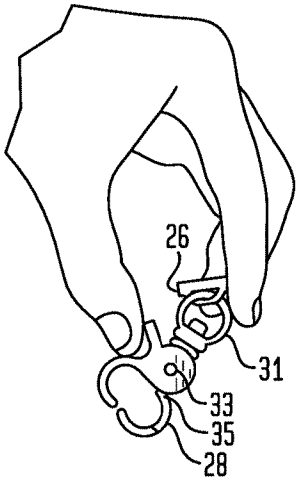
Figure 19A:
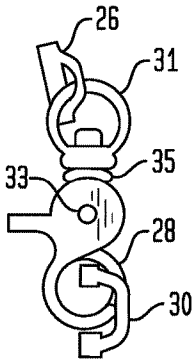
Figure 21:
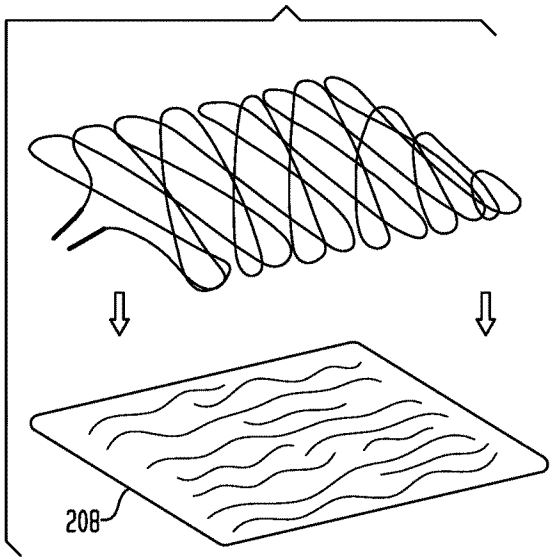
FIGS. 20-24 are isometric views that illustrate steps in the manufacture of an alternative security panel assembly.
Figure 22:
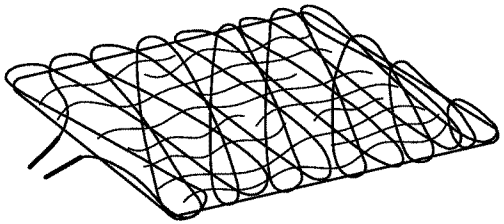
Figure 20:
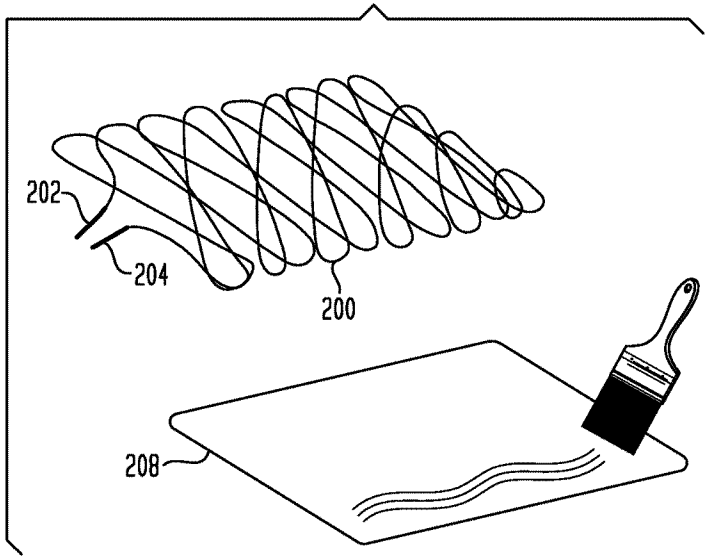
Figure 23:
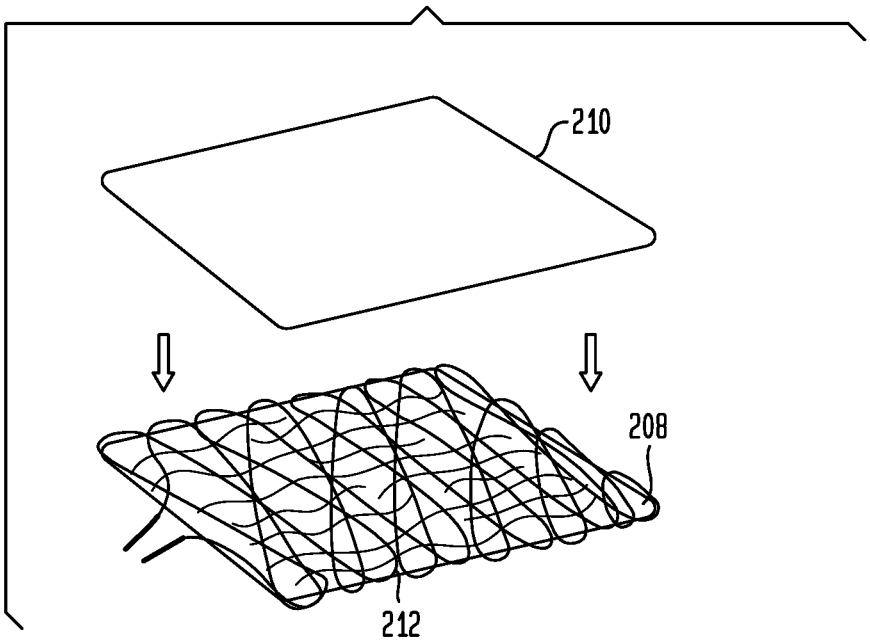
Figure 24:
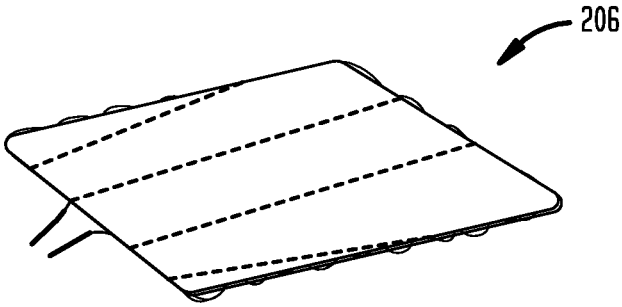

The zippers 24, 26 include a security feature as depicted in FIGS. 1 and 19. Thus, the zipper 26 includes a catch or tab 28 which may be inserted into a loop 30 that is attached to a base 32 affixed to the outer layer 34 forming the exterior bag 23. The catch 28 is mounted on a plate 35 by means of a pin 33. Plate 35 has a ring 31 attached to zipper 26. The catch 28 must be manually released by pivoting about pin 33 in order to enable movement and release from the loop 30. Thus, the zipper mechanisms 24, 26 are effectively locked to the bag 20 and require a manual release operation in order to enable operation of zippers 24, 26 to achieve access though zippered openings to the interior of the bag 20.

Figure 17:
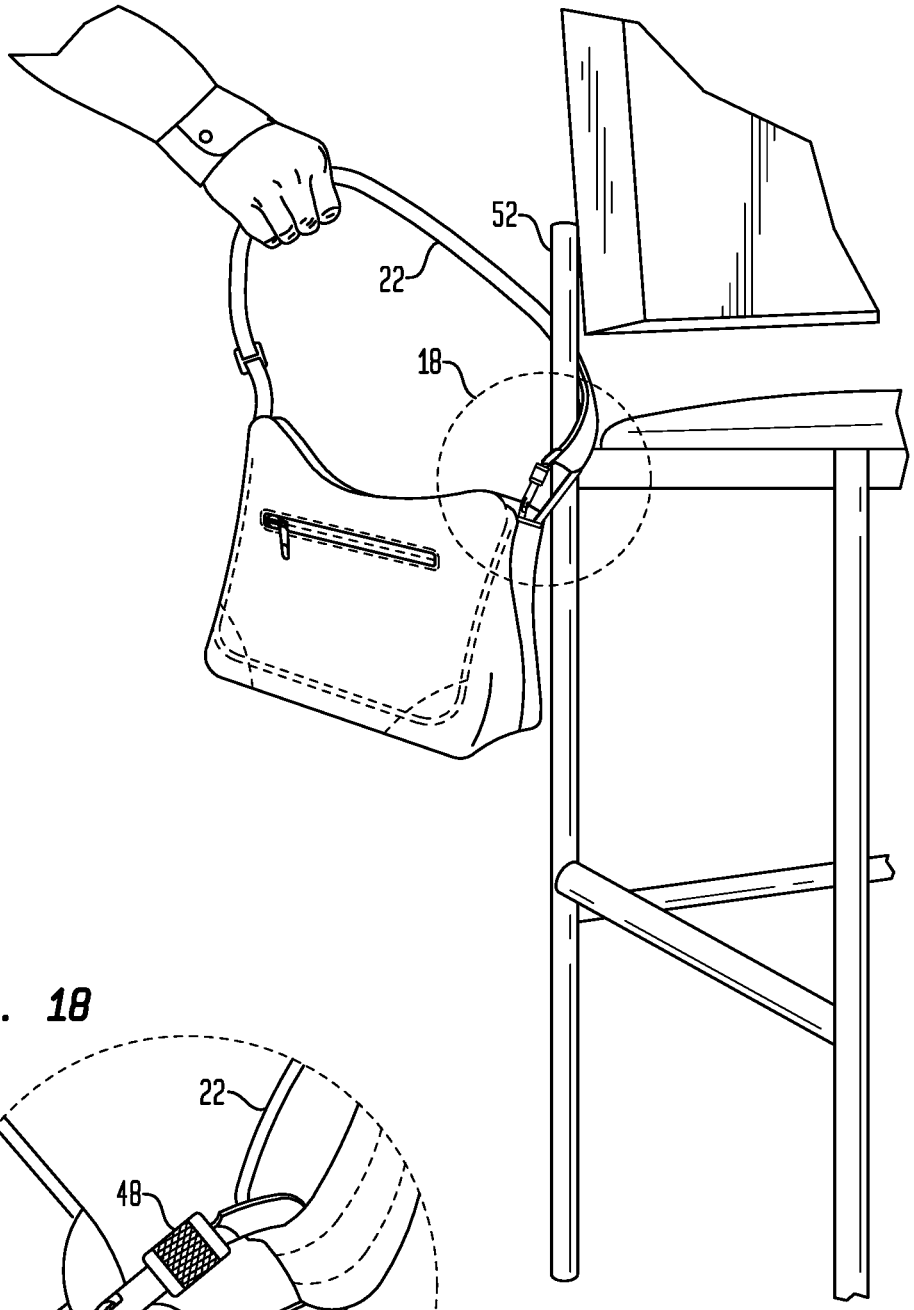
FIG. 17 is an isometric view that illustrates the inclusion and positioning of a carabiner associated with the carry strap of the embodiment of the security handbag of the invention.
Figure 18:
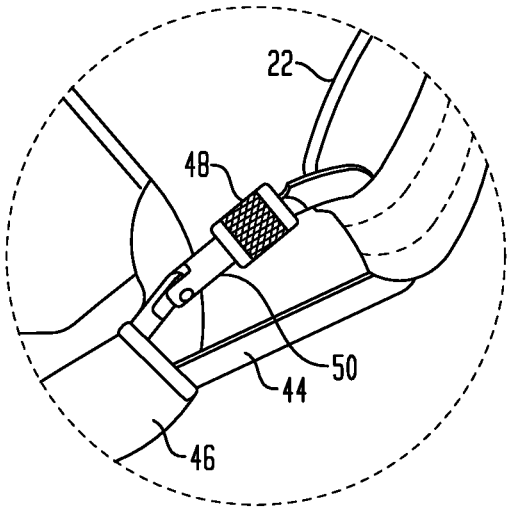
FIG. 18 is an enlarged isometric view of the carabiner construction of FIG. 17.

The carry strap 22 of bag 20 includes an elongate cable 38 which is sewn into and extends the entire length of the strap 22. Strap 22 is attached to bag 20 at one end and to a buckle 42 at its opposite end. The strap 22 also fits though buckle 42 and forms a loop 40 though a carabiner 44. Strap 22 thus forms a loop 40 which enables, in combination with a buckle 42, adjustment of the length of the strap 22. The strap 22 may have one end fastened into the interior of the exterior bag 20 or to a buckle 45 in FIG. 4 attached to a loop 47 affixed to bag 20. The opposite end of the strap 22 is attached to buckle 42. The carabiner 44 is also attached to the bag 20 and slidably fits within a pocket 46 in the side of the exterior bag 20. In order to release the carabiner 44 from loop 40 and open the carabiner 44, a rotatable socket 48 must be manually manipulated. This construction is shown in more detail in FIGS. 18 and 19 wherein the carabiner 44, which slidably fits into the pocket 46 and thus remains generally hidden during use, is released once the socket 48 is unthreaded so that a pivotal are 50 of the carabiner 44 maybe manipulated to open the carabiner 44 so that the loop 40 of strap 22 may be fitted around a post such as a support of a chair or post 52 as depicted in FIG. 17 to thereby retain the bag securely attached to the chair. In other words, the strap 22 is a security feature of the construction by enabling the placement around a post or some other object to prevent ease of snatching the bag 20.

Figure 2:
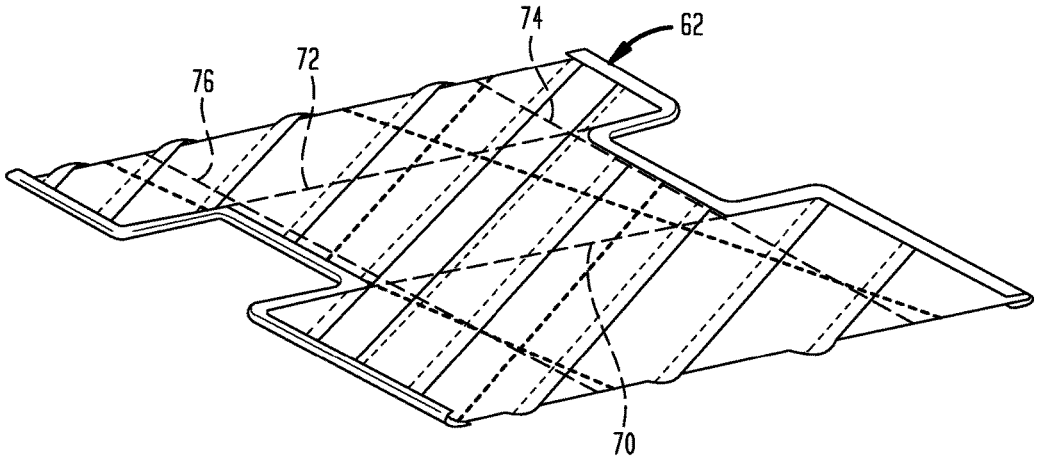
FIG. 2 is an isometric view of the panel assembly of FIG. 4 in a folded condition to form an interior security insert within the chamber formed by the exterior bag.
Figure 3:
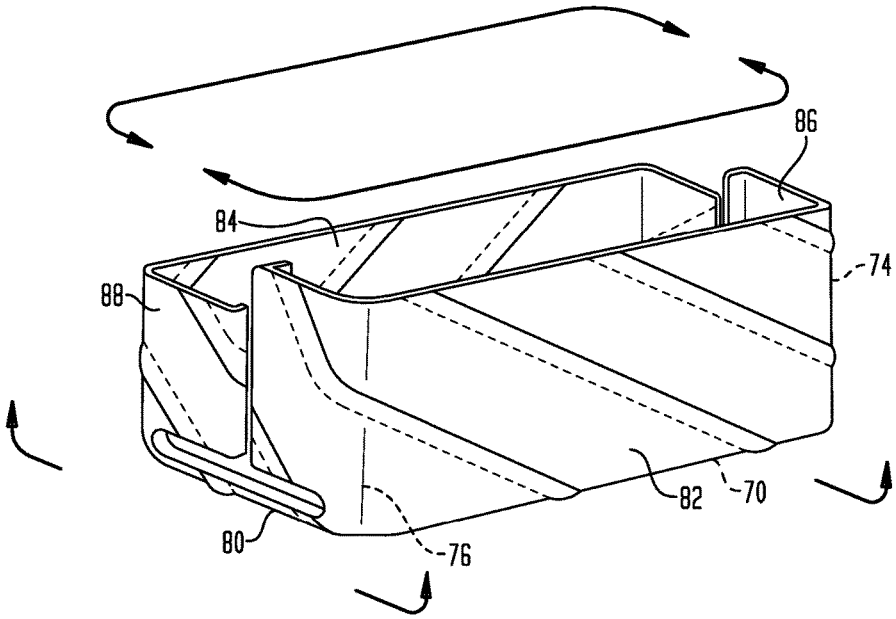
FIG. 3 is an isometric cut-away view showing the placement of the folded panel assembly of FIG. 2 within the exterior bag construction of FIG. 1.
Figure 4:
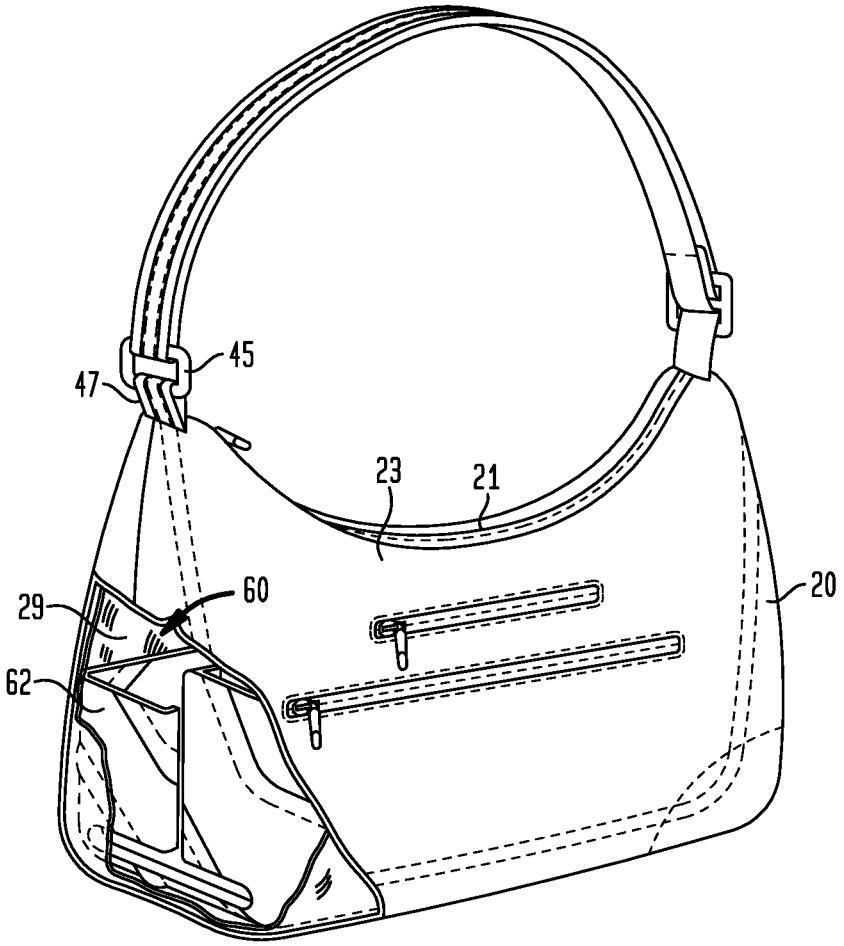
FIG. 4 is an isometric view of an interior security panel assembly which is fabricated and then inserted into an exterior bag and more particularly to the inside chamber of an exterior bag between the material forming the outside layer of the exterior bag and a lining of the exterior bag.

Referring next to FIGS. 2-4 there is depicted the configuration and assembly of an interior panel security assembly 62 which is retained within the bag 20. The interior panel assembly 62 is fabricated in a manner which enables the handbag 20 to remain flexible, yet provides a significant amount of security by preventing cutting though the bag 20 to the interior 60 of the bag 20 for access of its contents. Specifically, the interior security panel assembly 62 is comprised of layers of foldable material which are stitched together over a matrix of wires or cables of cut-resistant material, which can be synthetic or metallic, for example. The panel assembly is then positioned within the bag 20 and maintained within the interior 60 of the bag 20. Thus, a chamber 60 is formed in the bag 20 and typically between a lining 29 in that chamber 60 and the exterior fabric material 23 or other material defining the bag 20.

Alternatively, referencing FIGS. 20-24 a single wire 200 could be employed that is routed along and across the material layers therebetween as by looping thereof to avoid having more than two ends 202 and 204 of the wire that need to be addressed at an edge of the panel assembly 206.

An interior security panel assembly 62 is depicted in greater detail in FIGS. 3 and 4. Referring to FIG. 2 the interior security panel assembly 62 in the embodiment depicted is comprised of a single panel having a profile that can be described as the profile of the Roman Numeral I. Other configurations, such as a T or U-shape could also be employed depending on the configuration of the bag and where the security panel is needed for protection. The panel assembly 62 is, in this instance, comprised of a single panel which is foldable along fold lines 70, 72, 74 and 76. When so folded, the panel assembly 62 defines generally the shape of a box as depicted in FIG. 3. Thus, by folding or shaping along the fold line 70 as well as the lines 74 and 76, a box-like structure is formed having a bottom surface 80, opposite side surfaces 82 and 84 and end panels 86 and 88. This box-like assembly or box-like security panel assembly is formed during the manufacturing operation of the security handbag by tacking the panel 62 to the inside face of the material forming the exterior bag 23. Then a lining 29 may be placed over the panel assembly 62 and material forming the exterior bag 23. The layers of lining 29, panel 62 and exterior bag 23 may then be stitched together to form the bag 20. Adhesive may also be used to facilitate assembly. Preferably, stitching is used to form and create the bag 20. Lining 29 fits against the outside of the panel 62 to thereby encapsulate the panel assembly 62. The lining 29 and the exterior material 23 forming the exterior bag 20. Of course, in the practice of the invention, multiple discrete security panels or panel assemblies 62 may be combined to provide a composite interior panel assembly. The embodiment depicted provides an easy and preferred manner of connecting the security panel or panel assembly 62 to the exterior bag 23. The fold lines, for example fold lines 70 and 72, insure that the security of the chamber or interior 60 of the bag 20 is maintained since the wire matrix (as discussed hereinafter) is continuous though the fold lines and the step of forming the bag effectively insures that the panel 62 fits over essentially all of the interior walls of the bag 20 and lines the chamber 60.

Figure 25:
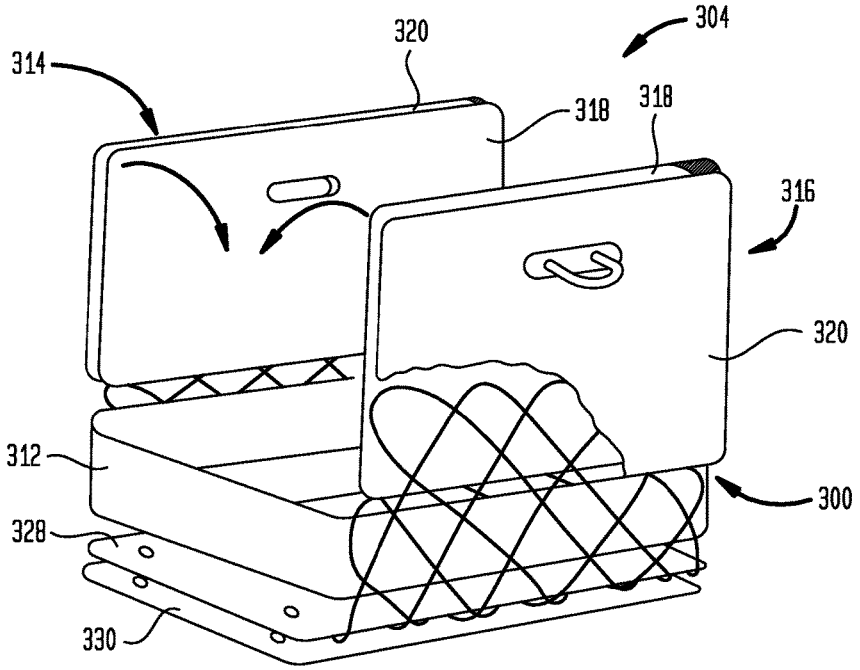
FIG. 25 is an isometric view of the security panel assembly used in a rigid bag application.
Figure 26:
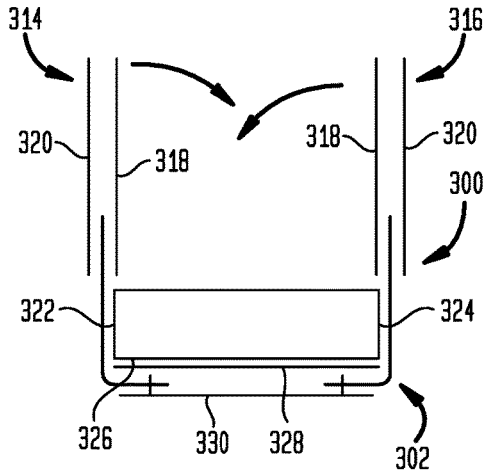
FIG. 26 is a sectional, schematic view showing the panel assembly extending up from the bottom of the bag frame along the cover members that close the rigid bag.
Figure 27:
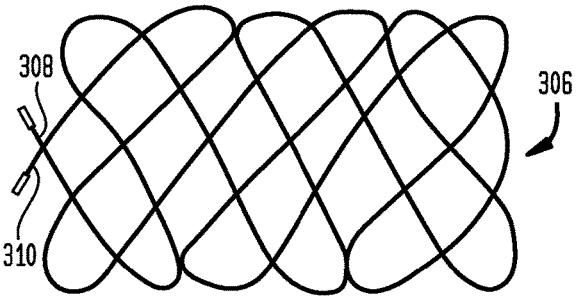
FIG. 27 shows the pattern of the cut-resistant cable used in the security panel assembly.
Figure 28:
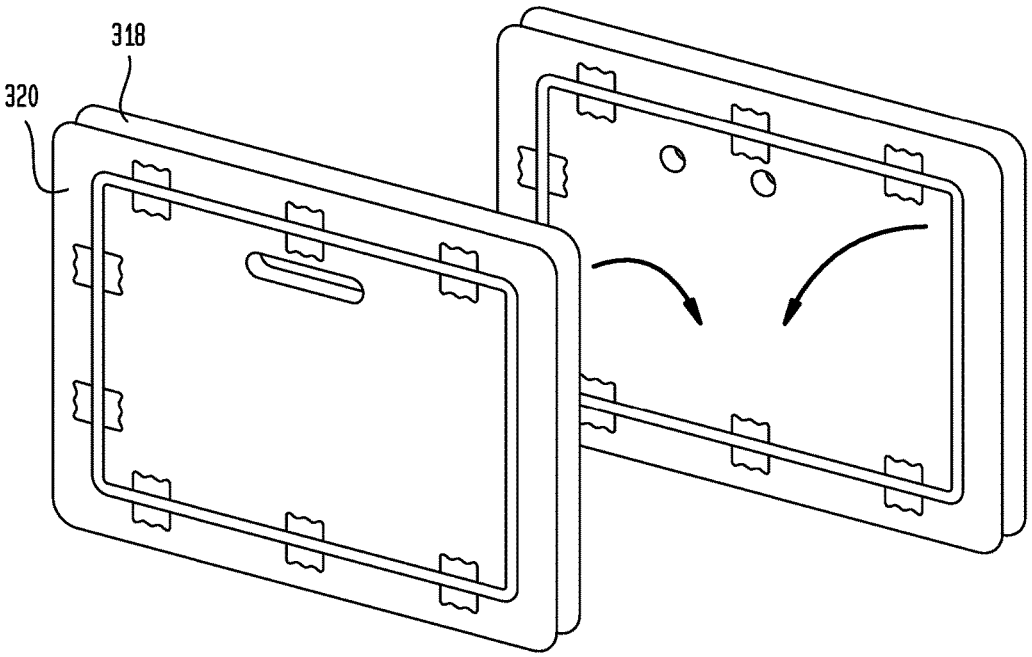
FIG. 28 shows reinforcement wire for the plates of the cover members.
Figure 29:
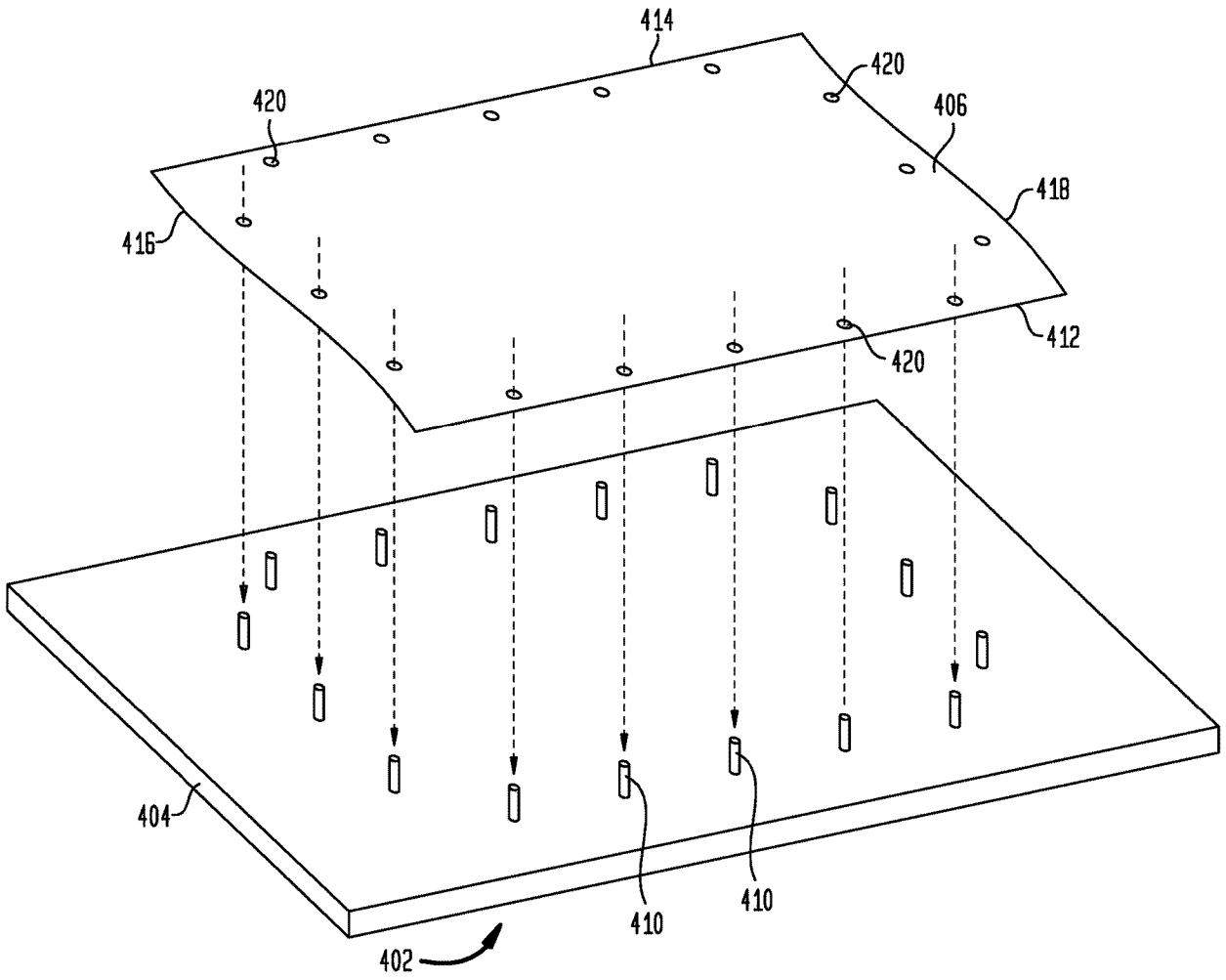

The security panel assembly described herein could also be used in a more rigid bag or container application. As shown in FIGS. 25-27, the security panel assembly 300 is used to pivotally connect a lower container base 302 to cover 304. In this regard, the panel assembly 300 can form a living hinge-type of connection between the base 302 and cover 304. As illustrated, the panel assembly 300 has a cut-resistant cable or wire 306 that is formed into loops and crosses itself along its length so that only two ends 308 and 310 of the wire 306 are present at an edge of the panel assembly 300.

The base 302 can be a metallic frame 312 having an open-top box configuration, and the cover 304 can include a pair of cover members 314 and 316 that cooperate to close the open-top of the box frame 312 when pivoted closed, and to provide access to the bag interior when pivoted open via panel assemblies 300 extending along either side of the box frame 312 and along the cover members 314 and 316 to form living hinges therebetween.

More specifically, the wire netting 306 extends and is captured between a pair of inner and outer metal plates 318 and 320 to form each cover member 314 and 316. These plates also can each have a reinforcement wire 321 that extends around their perimeter to provide rigidity thereto. Each wire netting 306 extends down along a corresponding side 322 and 324 of the frame 312 and around the bottom corners of the box frame 312 where it is secured at the bottom 326 of the frame 312. For this purpose, a metal plate 328 and a plastic plate 330 each substantially coextensive with the bottom 326 can be fixed thereto as by riveting to clamp and fix the bottom loops of the wire netting 306 therebetween, as shown in FIGS. 25 and 26.

FIGS. 5-16 illustrate multiple steps and their sequence for the formation of the interior panel 62.

Figure 6:
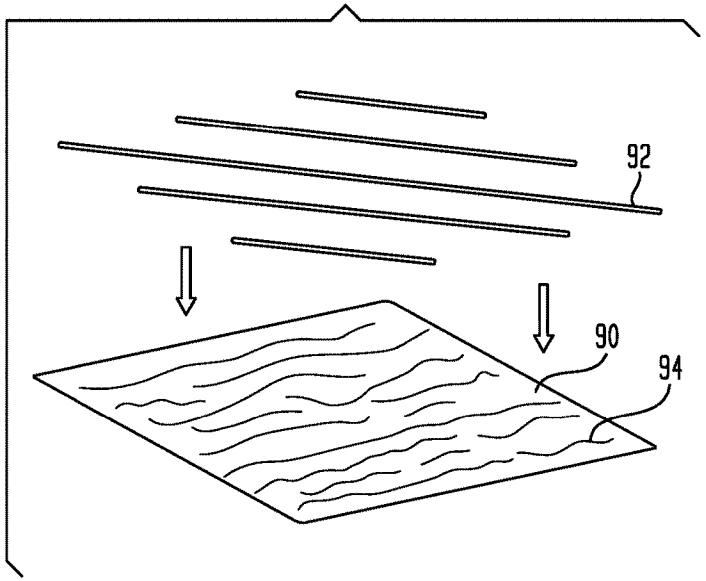
FIG. 6 is an isometric view of a future step in the construction of the interior security panel assembly.
Figure 7:
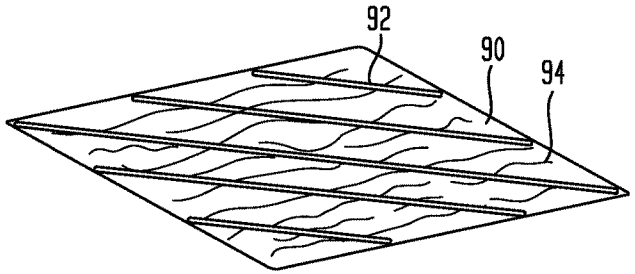
FIG. 7 is yet a further isometric view of an assembly step of the interior security panel assembly.
Figure 5:
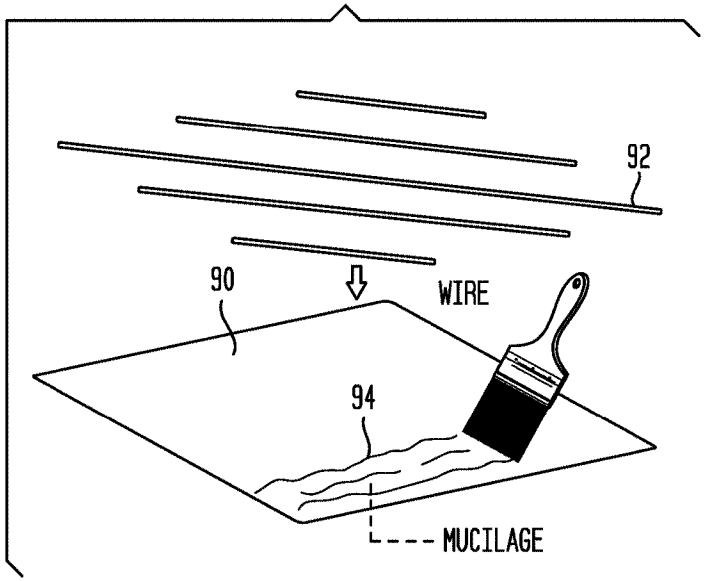
FIG. 5 is an isometric view illustrating a first step in the construction of the interior security panel assembly of the type depicted in FIG. 4.

FIG. 5 depicts a first step which is the cutting and formation of a first layer 90 of foldable material. The shape and configuration of the first layer 90 may be that of the Roman Numeral I as previously discussed or any desired shape associated with the design of the bag under construction. The layer 90 of material may be a fabric, plastic sheet or other foldable material. The choice of material is not necessarily a limiting feature of the invention. Wires 92 are then placed over the surface of the first layer 90 of material. The wires 92 may be retained in place by a glue or adhesive material 94. In this manner, the wire or wires 92 are secured against shifting relative to the material layer 90 so as not to be captured loosely between the material layers so that there is no need for extra holding devices such as crimps or the like to secure adjacent runs of the wire(s) to each other. The pattern of the wires 92 in the embodiment depicted is a series of spaced, parallel wires which run diagonally across the surface of the layer 90. FIGS. 6 and 7 illustrate in further detail the placement of the glue or adhesive 94 on the layer 90 and the positioning of the wires 92 on the layer 90 retained by the adhesive or glue material 94.

Figure 8:
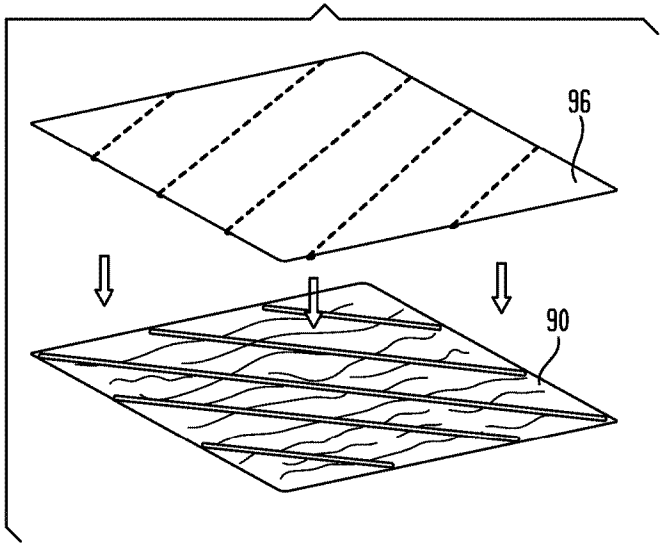
FIG. 8 is an isometric view illustrating the continued steps of manufacture of the interior security panel assembly.
Figure 9:
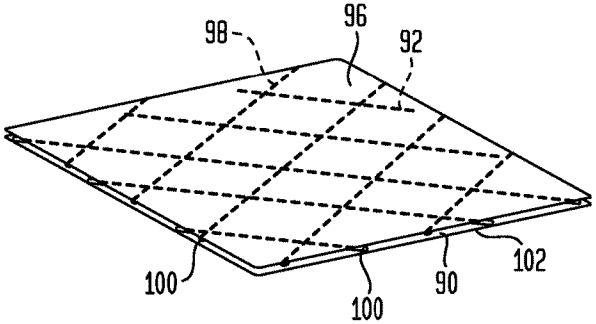
FIG. 9 is an isometric view of an additional manufacturing step associated with the interior security panel assembly.

A second layer 96, substantially identical to the first layer 90, is then prepared with adhered, spaced, parallel wires 98. Alternatively, one of the layers 90 and 96 can be fabric material while the other is a non-woven material. The second layer 96 is rotated 180° relative to the first layer 90 and placed over the first layer 90 as depicted in FIGS. 8 and 9. Thus, the second layer 96, which includes wires 98, is fitted over the first layer 90 which includes wires 92. Again, the pattern of the matrix is not a limiting feature. The chosen matrix in this case is a series of crossed wires which have ends 100 that terminate along a boundary 102, by way of example, of the panel layers 90 and 96.

Figure 10:
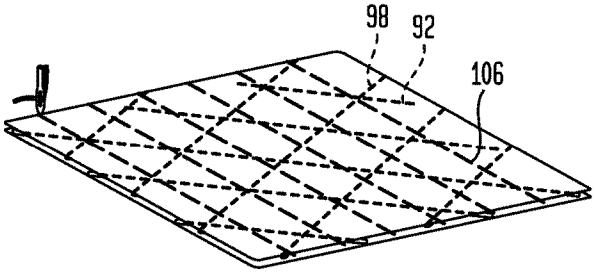
FIGS. 10, 11, 12, 13, 14, 15 and 16 are isometric views that illustrate continued steps in the manufacture of the interior security panel assembly in serial order.

As the next step, illustrated in FIG. 10, the wires 98 and 92 are stitched into position for retention in the desired position by means of a stitching with nylon or thread 106, for example. The wires 92, 98 are retained substantially in position between the layers 90 and 96 by means of the adhesive or glue 94 as well as the stitching 106.

Figure 11:
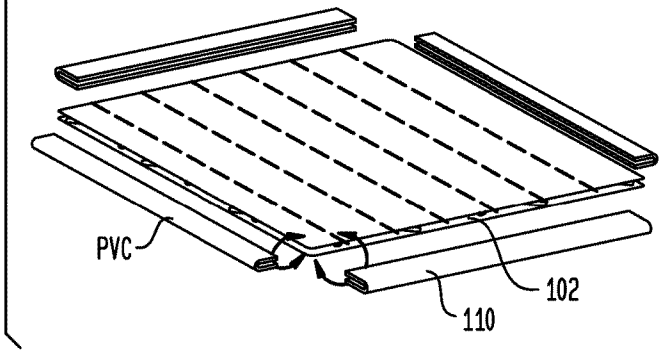
Figure 12:
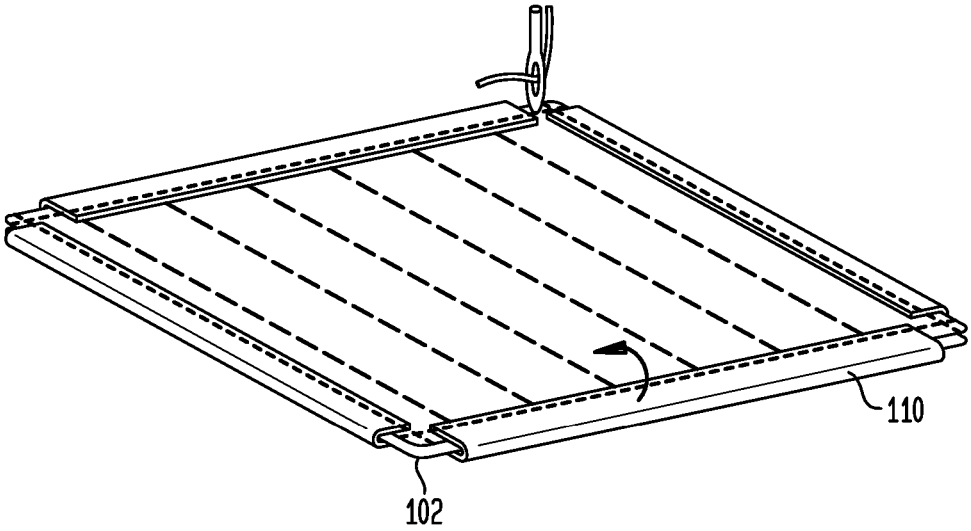
Figure 13:
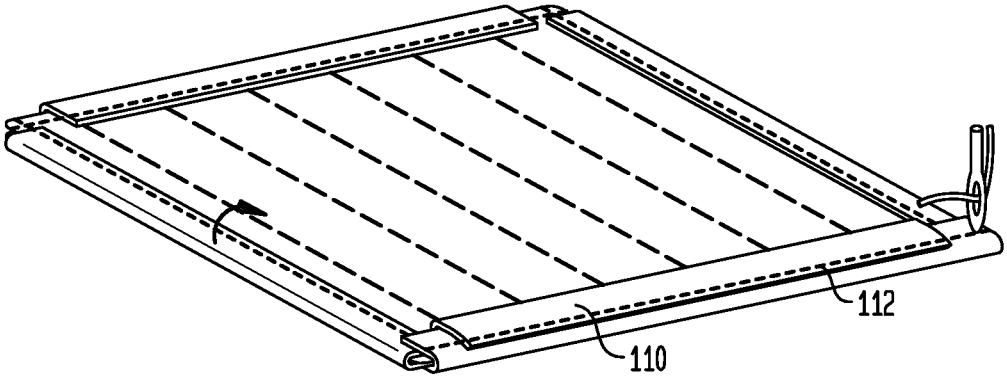

Thereafter, a binding material 110 is provided at least along some of the boundary or edges 102 of the security panel assembly 62 as depicted in FIG. 11. Thus, a binding material 110 such as a PVC binding material or any other type of somewhat flexible binding material 110 is fitted over the edge boundary 102 of the panel assembly 62 and subsequently, upon being fitted, is folded over the boundary edge 102 as depicted in FIG. 12. The folded binding 110 is then stitched along stitch line 112 to form an edge of the panel assembly 62. The use of a polyvinyl chloride binding 110 or a similar material insures that the ends 100 of wires 92 and 98 will not pierce or project outwardly from the panel assembly. Of course, the wires 92 and 98 are bendable or flexible and thus may be a light cable material or screen wire or some other material that is not easily cut. Typically the wires 92 and 98 are a metal wire such as 0.7 mm or steel wire, but any material which is resistant to cutting can be utilized in the construction. Typically, the wires 92, 98 are in parallel, spaced rows spaced 0.50 to 2 inches.

Figure 14:
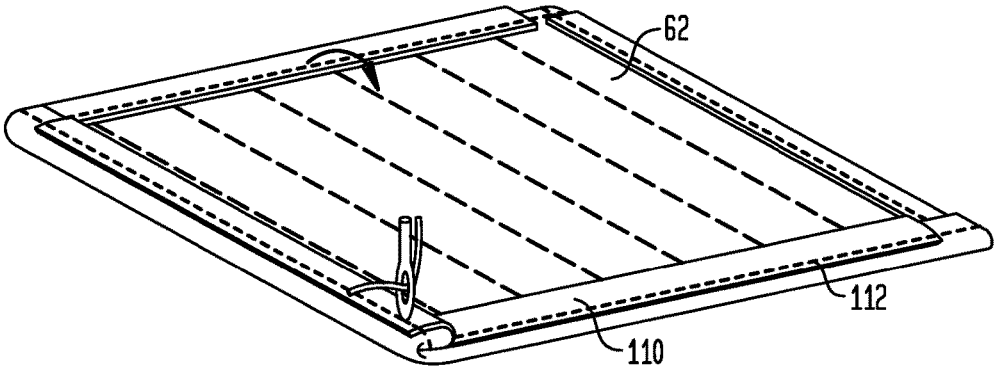
Figure 15:
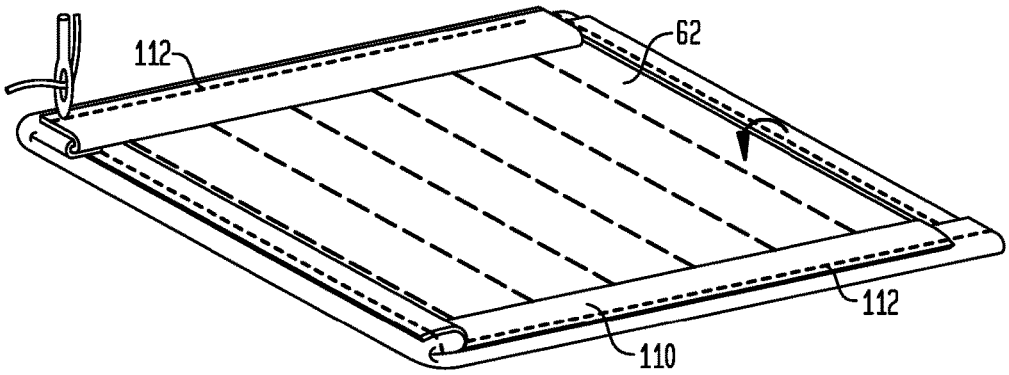
Figure 16:
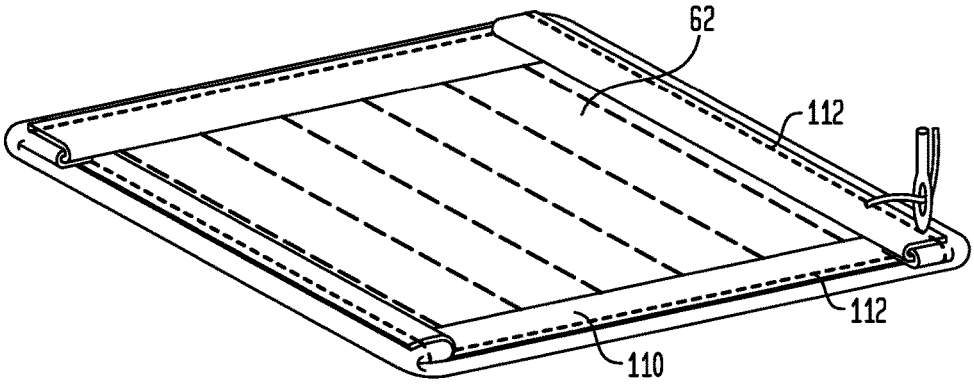

Subsequently, as depicted in FIGS. 14 and 15 all of the panel edges 102 are bound so that the wires 92, 98 will not pierce or project undesirably from the interior security panel assembly 62. The binding 110 is thus preferably provided about the entire circumference of the interior panel assembly 62. In the illustration, the panel assembly 62 has a square configuration rather than that of a Roman numeral I. However, the configuration of the interior panel assembly 62 is not a limiting feature of the invention.

Similarly, referencing FIGS. 20-24, the illustrated panels 208 and 210 can have other configurations as previously discussed. Each of these panels has a single wire, wire 200 for panel 208 and wire 212 for panel 210, that is fixed as by adhesive thereto. As shown, these wires are looped adjacent the panel edges to avoid numerous free ends of multiple wires thereat instead only having the single pair of ends adjacent one of the side edges of each panel. Further, these wires cross themselves but because they are adhered to the associated panel, they do not require crimps or the like to hold the adjacent wire portions together to maintain the wire extending in a desired pattern along the panels.

After the security panel assembly 62 is fabricated, it is incorporated into a bag 20 in the manner described previously. The assembly 62 is thus incorporated as a security layer within the bag 20.

The cable member 38 associated with the strap 22 may be attached to the interior panel assembly 62. The shape and configuration of the exterior bag 23 and the interior panel assembly 62 may be varied in accord with a design consideration. The inclusion of one or more interior panel assemblies 62 within an exterior bag 23 may be adopted.

Figure 30:
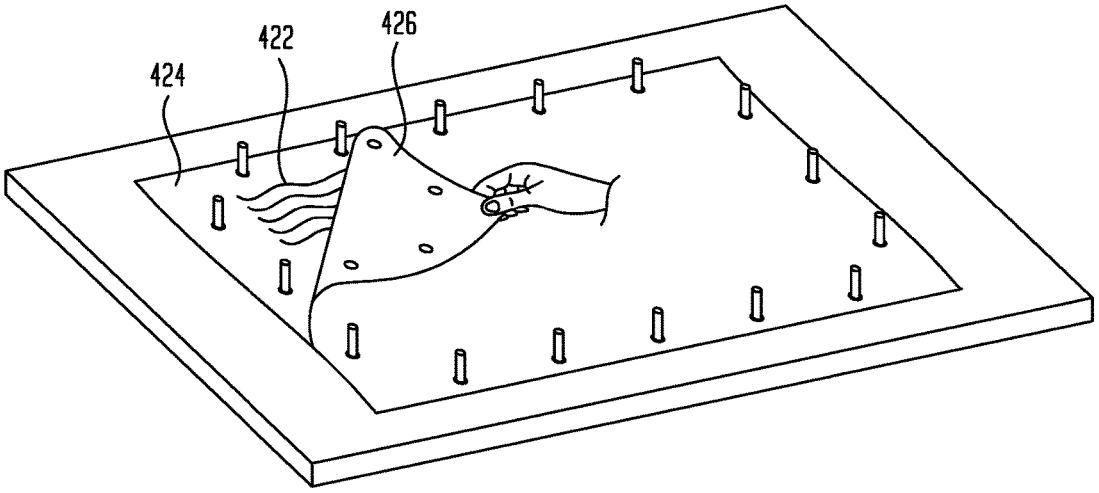

The steps for manufacture of an alternative security panel assembly 400 (FIG. 36) will next be described with reference to FIGS. 29-36. A fixture 402 such as a small handloom is provided for forming the security panel assembly 400. The fixture 402 includes a mounting base or board 404 that is larger than the layers of material 406 and 408 to be received thereon for forming the security panel assembly 400. The mounting board 404 includes several mounting members in the form of pegs 410 that project upwardly therefrom. The mounting pegs 410 can be arranged in parallel rows with a first pair of the parallel rows corresponding to opposite parallel edges 412 and 414 of the material layer 406 and the other or second pair of parallel rows being oriented to extend orthogonal to the first pair of rows and corresponding to the other pair of parallel edges 416 and 418 of the material layer 406. Through openings, holes, or apertures 420 are formed along and adjacent to the edges 412-418 such that they can be aligned with the mounting pegs 410 for fitting the mounting pegs 410 therethrough. In this regard, since the material layers 406 and 408 are preferably of flexible material such as non-woven or fabric material, the material layer 406 (as well as material layer 408 described more fully hereinafter) can be stretched for fitting the pegs 410 into and through its through openings 420. FIG. 30 shows the material layer 406 held to the mounting board 404 via the mounting pegs 410 extending through the openings 420.

At this time the material layer 406 can have adhesive 422 such as a pressure sensitive adhesive material exposed thereon on its upwardly facing surface 424. In one approach, the material layer 406 can include a covering sheet 426 made of a material that allows it to be readily removed from preapplied adhesive 422 thereunder. FIG. 30 shows the cover sheet 426 being pulled off from the material layer 406 so as to expose the adhesive 422 on the material layer surface 424. As an alternative to the use of the cover sheet 426, the adhesive 422 could be exposed on the surface 424 by applying it directly to the surface 424 of the material layer 406 as it is held on the mounting board 404 by the mounting pegs 410.

With the material layer 406 held on the mounting board 404, a cable or wire 428 can be dispensed from a wire fixture such as spooling mechanism 430 (FIG. 31) so that the wire 428 can be unwound and routed around the mounting pegs 410 projecting above the material layer 406. The wire 428 can be an approximately 0.1 mm to an approximately 3.5 mm, and preferably an approximately 0.6 mm, gauge or diameter wire of metallic material to provide the security panel assembly 400 resistance against being easily and/or quickly cut through. Alternatively, the cable or wire 428 can also be of a cut-resistant, yarn material such as Vectran which is a high-performance thermoplastic multifilament yarn spun from a liquid crystal polymer.

Figure 31:
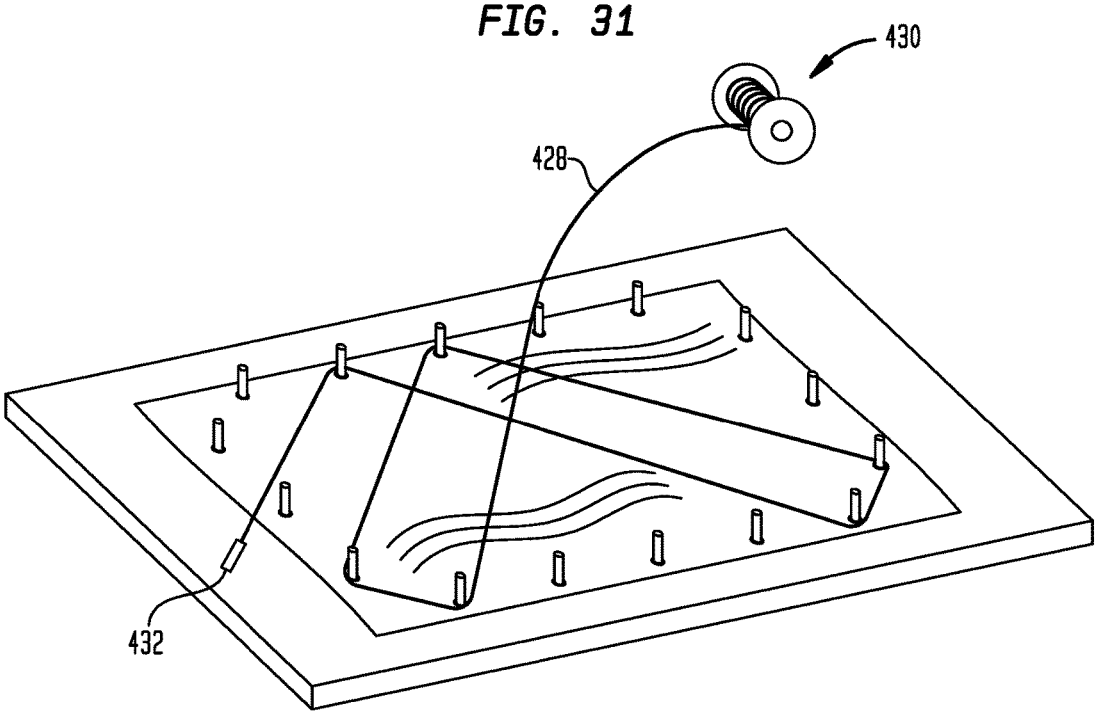
Figure 32:
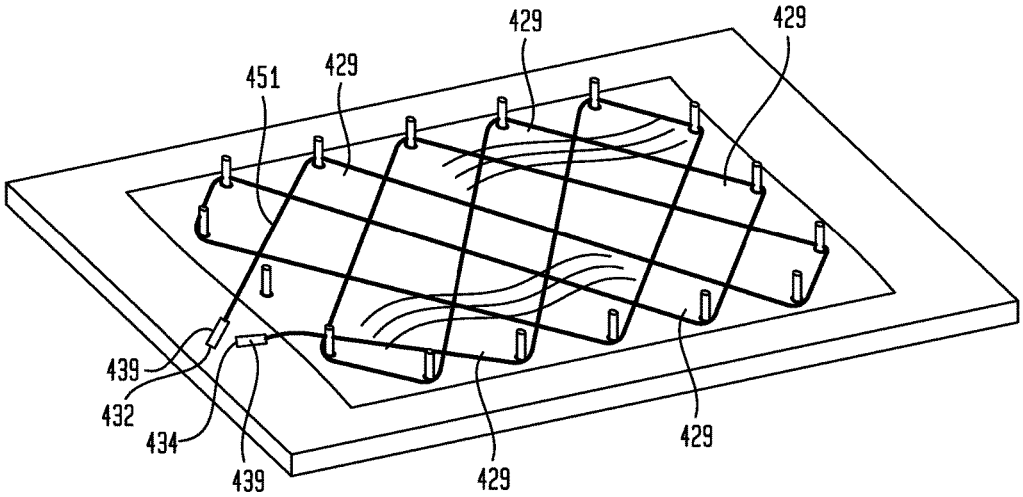

As can be seen in FIGS. 31-33, the wire 428 can be continuously routed around the pegs 410 in a predetermined pattern, such as the illustrated criss-cross pattern whereby the single length or piece of wire 428 forms a series of wire boxes 429 having their sides oriented at an oblique angle to the perimeter edges 412-418 of the material layer 406. The pegs 410 are of sufficient length so that the wire 428 can be routed tightly around the pegs 410 in spaced relation to the material layer surface 424 and the adhesive 422 thereon. This allows the wire 428 to be smoothly routed around the pegs 410 without potentially creating hang-ups during this process by contact with the adhesive material 422 thereunder.

As shown, the present method allows for use of a single wire 428 so that only two ends 432 and 434 need to be manipulated adjacent to one of the edges 412-418 so as not to be exposed therefrom such as by projecting beyond any of the edges 412-418 or being too closely adjacent thereto. For example, referring FIG. 33 (divided into FIG. 33A and FIG. 33B) the wire 428 at the ends 432 and 434 is bent back to extend toward the center 470 of the material layer 406 with the ends 432 and 434 being secured to and on the upwardly facing surface 424 adjacent the end edge 416 of the material layer 406. This leaves only bent or curved portions 435 of the wire 428 adjacent to the edges 412-418 and closed thereto. After the second material layer 408 is adhered to the first material layer 406 (as will be described hereinafter), the edges of the resulting laminate structure will be substantially sealed without multiple pairs of wire ends adjacent thereto. Thus, the security panel assembly 400 avoids the need to have a protective covering or binding along its perimeter edges that spans the covering layers 406 and 408 to prevent access to multiple pairs of exposed metallic wire ends.

Figure 33A:
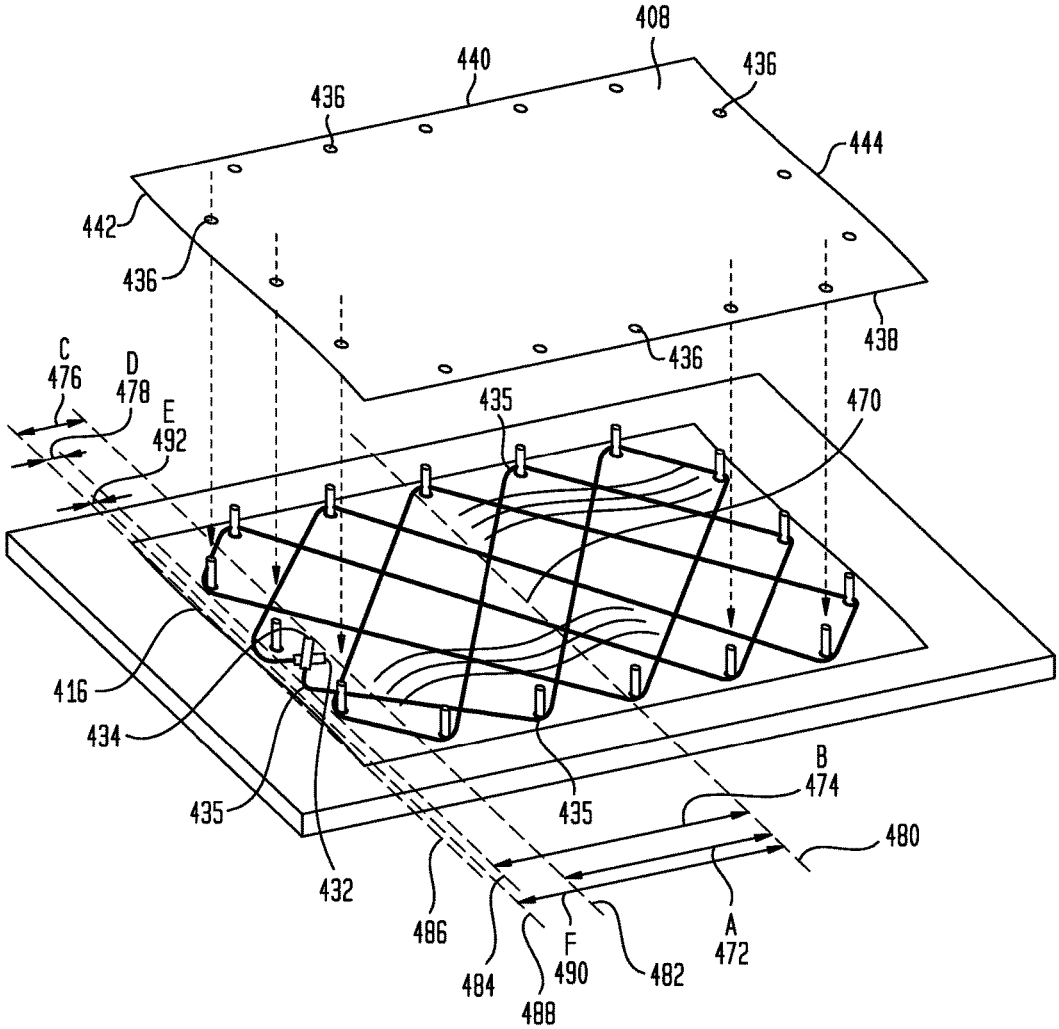
Figure 33B:
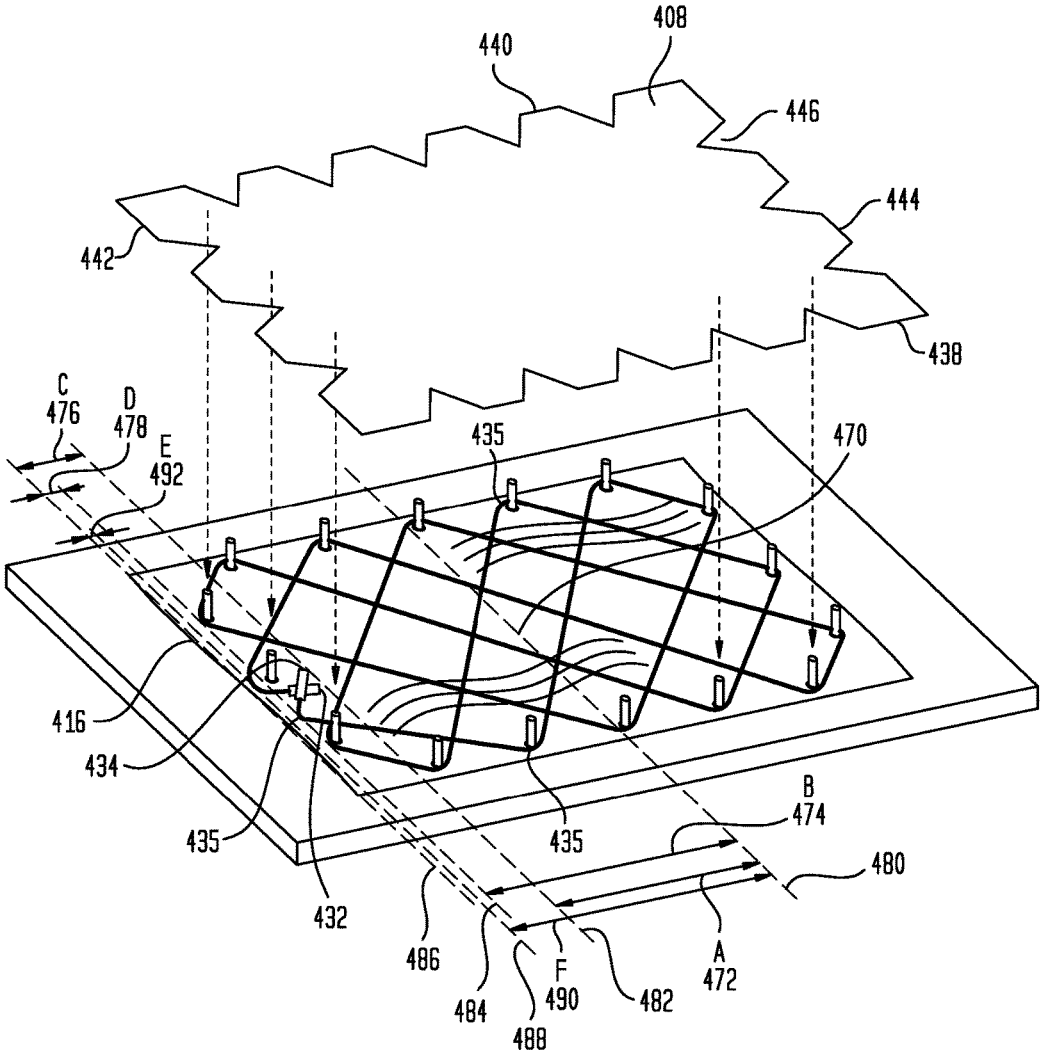

Referring to FIG. 33A and FIG. 33B, the at least one wire 428 is arranged as a plurality of bent or curved portions 435 spaced apart from the periphery (edges 412, 414, 416, 418) of the first flexible material layer 406 with the at least two ends 432 and 434 spaced apart from the periphery (edges 412, 414, 416, 418) further than and closer to a center 470 of the first flexible material layer 406 than the curved portions 435 of the wire matrix. As illustrated, for example, each wire end 432, 434 is spaced apart from the edges 412-418 (forming the periphery of the first material layer 406) further than the bent or curved portions 435 of the wire matrix, with the spatial or distance interval "C" (476) (the spatial interval between dashed reference lines 486 and 482) being greater than both the spatial or distance intervals "D" (478) (the spatial interval between dashed reference lines 486 and 484) and "E" (492) (the spatial interval between dashed reference lines 486 and 488). Similarly, also as illustrated, each wire end 432, 434 is spaced closer to the center 470 than these bent or curved portions 435 of the wire matrix along the edge 416, with the spatial or distance interval "A" (472) (the spatial interval between dashed reference lines 480 and 482) being less than both the spatial or distance intervals "B" (474) (the spatial interval between dashed reference lines 480 and 484) and "F" (490) (the spatial interval between dashed reference lines 480 and 488).

Further, it can be seen that the wire ends 432 and 434 can be provided with a cap thereon that can be of polymeric material such as a PVC tube to avoid having exposed metal ends of the metallic wire 428 between the material layers 406 and 408. This keeps the wire ends 432 and 434 from protruding and poking through the material layers 406 and 408. The leading end 432 can be capped before the wire 428 is routed around the pegs 410. After such routing is complete, the wire 428 can be cut to generate the second or trailing end 434 that is then capped. Manifestly, multiple wires could also be used as desired with additional wires being routed around the mounting pegs 410 and secured to the surface 424 via the adhesive 422 in a manner similar with the wire 428 with the ends of these additional wires also bent back and capped. In this regard, the multiple wires need not be directly connected to each other with separate connector members or clips which would increase cost and potentially generate localized bumps in the security panel assembly 400 where the connectors are located. As such, the only increase in the thickness of security panel assembly 400 over that of the material layers 406 and 408 is due to the thickness of the wire 428 secured therebetween.

Figure 34:
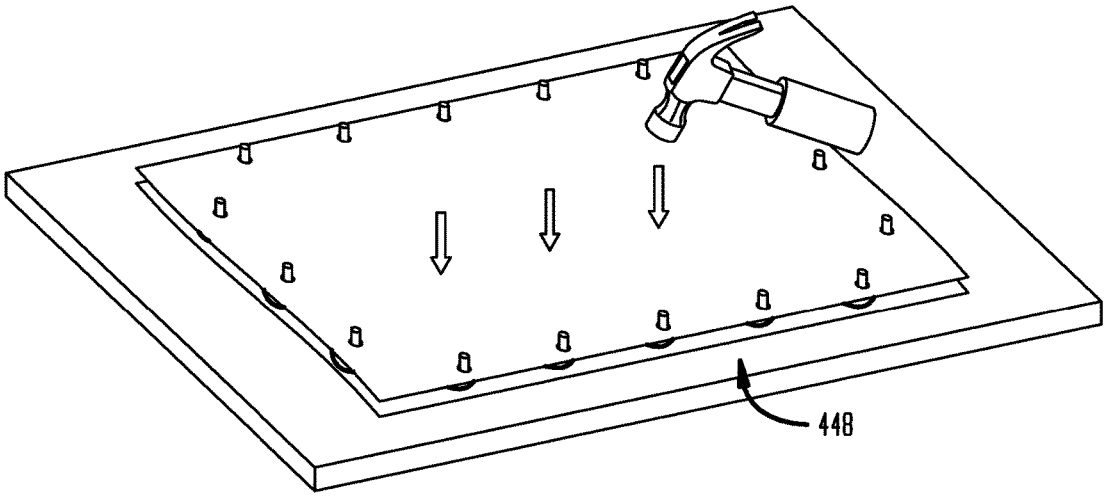
Figure 35:
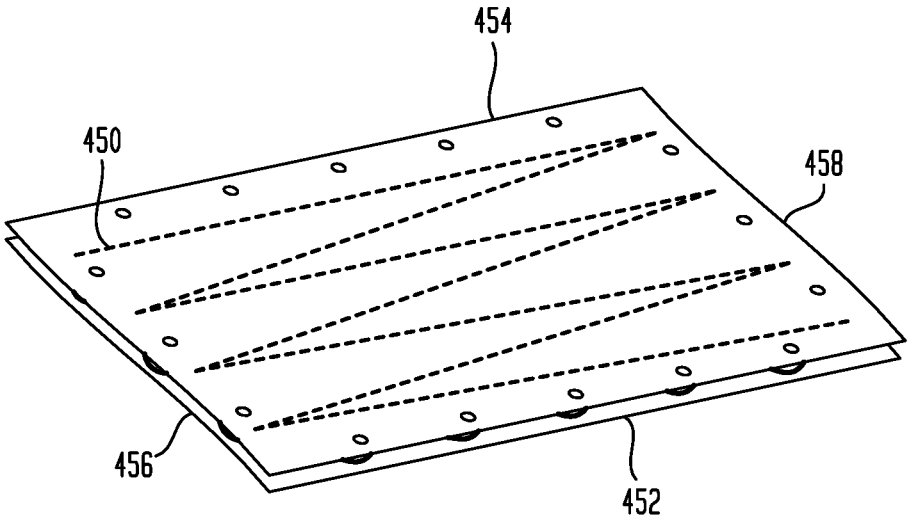
Figure 36:
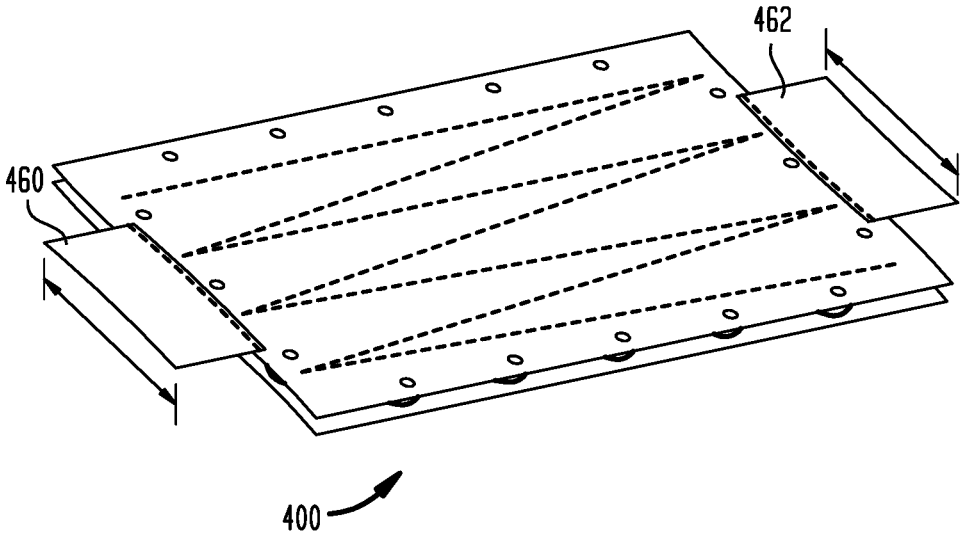

After the wire 428 is routed around the mounting pegs 410 and the wire ends 432 and 434 are capped and are placed on the adhesive 422 of the upwardly facing surface 424, the second material layer 408 is oriented so that its openings 436 are in alignment with the mounting pegs 410 so that the mounting pegs 410 can be received therethough, as shown in FIG. 34. In this regard, the through openings 436 are located along and adjacent to the opposite side edges 438 and 440 and the opposite end edges 442 and 444 in a manner similar to the positioning of the openings 420 along the edges 412-418 of the first material layer 406.

Since it can be difficult to simultaneously fit multiple pegs 410 through corresponding openings 436, generally the material layers 406 and 408 have to be manipulated so that each opening 424, 436 is individually fit over a corresponding mounting peg 410 or only a few openings 424, 436 at a time are fit over corresponding pegs 410, as illustrated in FIG. 33A. Thus, in another form, it is contemplated that rather than having the openings configured to be through openings or apertures 436 that are spaced from the corresponding edges 438-444, notch openings 446 could be formed in the material layer 408 instead, as illustrated in FIG. 33B. These notch openings 446 would open to the corresponding edges 438-444 and can have a V-shape for locating the mounting pegs 410 at or adjacent to the apex of the V-notch openings 446. This allows for the second material layer 408 to be quickly placed down onto the wire 428 for being adhered to the underlying first material layer 406 with multiple mounting pegs 410 or all of the pegs 420 substantially simultaneously fit into the corresponding notch openings 446. In this manner, assembly time for forming the security panel assembly 400, and specifically for the application of second material layer 408 onto the wire 428 can be significantly reduced.

After the second material layer 408 is held to the mounting board 404 via either the mounting pegs 410 extending in and through the through openings 436 or in and through the notch openings 446, pressure is applied to the second material layer 408 either manually or via a hand held tool so as to generate secure and intimate contact between the second material layer 408, the wire 428, the adhesive 422 on the first material layer 406, and the first material layer 406 itself. After applying sufficient pressure across the second material layer 408, a laminate structure 448 is created with the wire 428 secured and adhered between the adhered together first and second material layers 406 and 408, as shown in FIG. 34.

The laminate 448 is then removed from the fixture 402 by lifting of the material layers 406 and 408 off of the mounting pegs 410, whereupon stitching 450 is applied as by a sewing machine with the stitches interconnecting the material layers 406 and 408 and further securing the wire 428 permanently in place between the material layers 406 and 408. The stitching 450 can be at random locations along the laminate 448 as well as along the perimeter thereof corresponding to material layer edges 412-418 and 438-444. As shown, the stitching 450 extends along opposite long side edges 452 and 454 of the laminate 450 and along oblique lines that extend between the opposite shorter end edges 456 and 458 of the laminate 448. In addition, panel members can be connected to the security panel assembly 400 as by stitching along any of the perimeter edges 452-458 thereof. Any number or size of panel members can be utilized which serve as bridge connectors to provide assistance for attaching and incorporating the security panel 400 into a carry bag to be integrated therein as has been described herein. As shown, the panel members are in the form of opposite tab members 460 and 462 that are centrally connected along the shorter end edges 456 and 458 of the security panel assembly 400.

The specification and claims are intended to be interpreted broadly with respect to the scope and meaning of adjectives, adverbs and prepositions as well as nouns and verb forms. By way of example, though specific claim language may include the word "between", the interpretation of such a word shall not be limited to preclude extent of elements beyond boundaries of the example unless specific disclaimer is made or unless by virtue of prosecution the term is to be limited. Articles are also not to be limited and articles such as "a" and "an" shall not be limited to a single item or element unless specifically disclaimed. The examples of the invention should therefore not be interpreted as limiting unless indicated as such.

Thus, while there has been set forth embodiments of the invention, the invention is to be limited only by the following claims and equivalents.

What is claimed is:

1. A carrying bag comprising:

an exterior bag having at least one opening for access to an interior of the exterior bag; and a security panel assembly extending within the interior of the exterior bag, the security panel assembly comprising:

a first flexible material layer, the first flexible material layer having a first side and a second side, the first flexible material layer having a plurality of edges; and a wire matrix coupled in its entirety, through stitches or adhesive, on the first side of the first flexible material layer, the wire matrix comprising:

at least one wire having at least two ends coupled on the first side of the first flexible material layer, the at least one wire arranged as a plurality of wire crossings, each wire crossing comprising at least two sections of wire abutting and crossing over each other;

the at least one wire further arranged as a plurality of bent or curved portions coupled on the first side of the first flexible material layer and having multiple bent or curved portions of the plurality of bent or curved portions coupled adjacent and spaced apart from each edge of the plurality of edges of the first flexible material layer, with the multiple bent or curved portions of the plurality of bent or curved portions which are adjacent to and spaced apart from each edge further arranged closer to that edge, of the plurality of edges, than the at least two ends of the at least one wire; and at least one cap, polymer material or adhesive coupled on at least one end of the at least two ends of the at least one wire and further coupled on the first side of the first flexible material layer.

2. The carrying bag of claim 1, further comprising:

a second flexible material layer stitched over the wire matrix to the first side of the first flexible material layer.

3. The carrying bag of claim 2, further comprising:

an adhesive for attaching at least part of the wire matrix to the first side of the first flexible material layer and to the second flexible material layer.

4. The carrying bag of claim 2, wherein the first and second flexible material layers are stitched together into the exterior bag.

5. The carrying bag of claim 2, wherein the first flexible material layer, or the second flexible material layer, or both the first and second flexible material layers comprise a fabric material or a polymer material.

6. The carrying bag of claim 1, wherein the wire matrix is comprised of a single wire arranged to form the plurality of wire crossings and the plurality of bent or curved portions.

7. The carrying bag of claim 1, further comprising:

a polymeric or adhesive material coupled to at least part of the at least one wire.

8. The carrying bag of claim 1, further comprising:

a first fastener coupled to the at least one opening;

a second fastener coupled or removably couplable to the first fastener; and a carrying strap comprising a wire or polymer cable.

9. The carrying bag of claim 8, further comprising:

a third, locking fastener coupled or removably couplable to the carrying strap.

10. The carrying bag of claim 8, wherein the first fastener is a zipper having a zipper pull.

11. The carrying bag of claim 8, wherein the second fastener is a manually-releasable clasp or is a third, locking fastener.

12. The carrying bag of claim 1, further comprising:

a flexible material lining.

13. The carrying bag of claim 1, wherein the plurality of wire crossings form a plurality of closed wire shapes, at least some of the plurality of closed wire shapes comprising at least four wire crossings of the at least one wire.

14. The carrying bag of claim 1, wherein the security panel assembly further comprises:

at least one tab, flange or panel member.

15. A carrying bag comprising:

an exterior bag having at least one opening for access to an interior of the exterior bag;

a security panel assembly extending within the interior of the exterior bag, the security panel assembly comprising:

a first flexible material layer, the first flexible material layer having a first side and a second side, the first flexible material layer having a plurality of edges; and a wire matrix coupled in its entirety, through stitching or an adhesive, on the first side of the first flexible material layer, the wire matrix comprising:

at least one wire having at least two ends coupled on the first side of the first flexible material layer, the at least one wire arranged as a plurality of wire crossings, each wire crossing comprising at least two sections of wire abutting and crossing over each other; and the at least one wire further arranged on the first side of the first flexible material layer as a plurality of bent or curved portions with multiple bent or curved portions of the plurality of bent or curved portions arranged adjacent to and spaced apart from each edge of the plurality of edges of the first flexible material layer with the multiple bent or curved portions adjacent each edge arranged closer to that edge, of the plurality of edges, than the at least two ends of the at least one wire;

an adhesive or polymer coupled to at least one end of the at least two ends of the at least one wire or to the first side of the first flexible material layer; and a second flexible material layer coupled over the wire matrix to the first side of the first flexible material layer and stitched together with the first flexible material layer into the exterior bag.

16. The carrying bag of claim 15, wherein the wire matrix is comprised of a single wire arranged to form the plurality of wire crossings and the plurality of bent or curved portions.

17. The carrying bag of claim 15, wherein the adhesive or polymer is coupled to at least one end of the at least two ends and to the first side of the first flexible material layer.

18. The carrying bag of claim 15, further comprising:

a first fastener coupled to the at least one opening;

a second fastener coupled or removably couplable to the first fastener; and a carrying strap comprising a wire cable.

19. The carrying bag of claim 18, further comprising:

a third, locking fastener coupled or removably couplable to the carrying strap.

20. The carrying bag of claim 18, wherein the first fastener is a zipper having a zipper pull.

21. The carrying bag of claim 18, wherein the second fastener is a manually-releasable clasp or locking fastener.

22. A carrying bag comprising:

an exterior bag having at least one opening, the at least one opening having a zipper closure with at least one zipper pull;

a first, manually-releasable fastener coupled or removably couplable to the at least one zipper pull;

a carrying strap comprising at least one wire cable;

a second, locking fastener coupled or removably couplable to the carrying strap;

a first flexible material layer coupled to the exterior bag, the first flexible material layer having a first side and a second side, the first flexible material layer having a plurality of edges; and a wire matrix stitched or adhered in its entirety to the first side of the first flexible material layer, the wire matrix comprising:

at least one wire having at least two ends, the at least one wire arranged as a plurality of wire crossings and a plurality of bent or curved portions, with multiple bent or curved portions of the plurality of bent or curved portions arranged adjacent to and spaced apart from each edge of the plurality of edges of the first flexible material layer, with the multiple bent or curved portions which are adjacent each edge being arranged closer to that edge, of the plurality of edges, than the at least two ends or the at least one wire; and at least one cap or coating coupled on the first side of the first flexible material layer and covering each end of the at least two ends of the at least one wire;

and a second flexible material layer coupled over the wire matrix to the first side of the first flexible material layer.

23. The carrying bag of claim 22, wherein each end of the at least two ends is spaced apart from a corresponding edge of the plurality of edges further than the multiple bent or curved portions of the plurality of bent or curved portions of the wire matrix which are adjacent that corresponding edge.

24. The carrying bag of claim 22, wherein each end of the at least two ends is spaced apart from a selected edge of the plurality of edges further than the multiple bent or curved portions of the plurality of bent or curved portions of the wire matrix which are adjacent the selected edge.

25. The carrying bag of claim 22, further comprising:

wherein the first flexible material layer, or the second flexible material layer, or both the first and second flexible material layers, comprise a fabric material or a polymer material.

26. The carrying bag of claim 22, further comprising:

an adhesive or polymer coupled to at least part of the wire matrix or to the first side of the first flexible material layer.

27. The carrying bag of claim 26, wherein the wire matrix is comprised of a single wire arranged to form the plurality of wire crossings, and wherein the adhesive or polymer is coupled to at least one end of the at least two ends.

28. The carrying bag of claim 22, wherein the wire matrix is comprised of a single wire arranged to form the plurality of wire crossings, wherein the plurality of wire crossings form a plurality of closed wire shapes; wherein at least some of the plurality of closed wire shapes comprise at least four wire crossings of the single wire.

* * * * *